US009455538B2

(12) United States Patent
Nishio et al.

(10) Patent No.: US 9,455,538 B2
(45) Date of Patent: Sep. 27, 2016

(54) CARD EDGE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akihiro Nishio, Mie (JP); Masaaki Tabata, Mie (JP); Masanori Moriyasu, Mie (JP); Yasuo Omori, Mie (JP); Hajime Matsui, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi (JP)

( * ) Notice: Subject to any disclaimer, the term of this patent is extended or adjusted under 35 U.S.C. 154(b) by 0 days.

(21) Appl. No.: 14/654,594

(22) PCT Filed: Jun. 7, 2013

(86) PCT No.: PCT/JP2013/065888
§ 371 (c)(1),
(2) Date: Jun. 22, 2015

(87) PCT Pub. No.: WO2014/103404
PCT Pub. Date: Jul. 3, 2014

(65) Prior Publication Data

US 2015/0349469 A1 Dec. 3, 2015

(30) Foreign Application Priority Data

Dec. 28, 2012 (JP) ..... 2012-287430

(51) Int. Cl.
*H01R 12/53* (2011.01)
*H01R 13/66* (2006.01)

(Continued)

(52) U.S. Cl.
CPC ..... *H01R 13/665* (2013.01); *H01R 12/714* (2013.01); *H01R 12/721* (2013.01);
(Continued)

(58) Field of Classification Search
CPC ..... H01R 12/53; H01R 12/721
See application file for complete search history.

(56) References Cited

U.S. PATENT DOCUMENTS 4,003,014 A * 1/1977 Branson ..... H01C 1/148 219/270
4,528,530 A * 7/1985 Ketchen ..... H01L 39/045 257/E39.003

(Continued)

FOREIGN PATENT DOCUMENTS

JP 8-22852 1/1996
JP 2001-332324 11/2001

(Continued)

OTHER PUBLICATIONS

International Search Report of Sep. 10, 2013.

*Primary Examiner* — Gary Paumen
(74) *Attorney, Agent, or Firm* — Gerald E. Hespos; Michael J. Porco; Matthew T. Hespos

(57) ABSTRACT

A card edge connector includes a harness-side connector (H) in which a plurality of terminal fittings (50) are juxtaposed in a harness-side housing (10) and a board-side connector (P) in which a circuit board (62) is attached to a board-side housing (60). When the two housings (10, 60) are connected, the plurality of terminal fittings (50) are resiliently brought into contact with a plurality of contact portions (64) juxtaposed on the circuit board (62). The harness-side housing (10) includes a terminal accommodating portion (39) for accommodating the plurality of terminal fittings (50) in a state positioned in a juxtaposition direction, and at least a part of the terminal accommodating portion (39) is made of a material having a linear expansion coefficient substantially equal to that of a material of the circuit board (62).

7 Claims, 7 Drawing Sheets

(51) Int. Cl.

| | |
|---|---|
| ***H01R 13/436*** | (2006.01) |
| ***H01R 13/502*** | (2006.01) |
| ***H01R 12/71*** | (2011.01) |
| ***H01R 12/72*** | (2011.01) |
| ***H01R 13/52*** | (2006.01) |
| *H01R 13/422* | (2006.01) |
| *H01R 13/627* | (2006.01) |
| *H01R 13/64* | (2006.01) |

(52) U.S. Cl.
CPC ..... *H01R13/436* (2013.01); *H01R 13/502* (2013.01); *H01R 13/5208* (2013.01); *H01R 13/5213* (2013.01); *H01R 13/4223* (2013.01); *H01R 13/6272* (2013.01); *H01R 13/64* (2013.01)

(56) References Cited

U.S. PATENT DOCUMENTS 5,954,549 A * 9/1999 Shinchi ..... H01R 43/0207 156/73.1
6,053,769 A * 4/2000 Kubota ..... H01R 24/40 174/75 C
6,144,216 A * 11/2000 Kajiwara ..... G09G 3/006 324/73.1
6,164,993 A * 12/2000 Jiang ..... H01R 9/091 174/260
6,275,669 B1 * 8/2001 Hasegawa ..... H01R 4/4809 399/330
7,891,981 B1 * 2/2011 Patelzick ..... H05K 7/142 174/138 G
7,985,079 B1 * 7/2011 Wilson ..... H01R 12/52 439/74
9,035,189 B2 * 5/2015 Pahl ..... H05K 1/189 174/254
2001/0051451 A1 * 12/2001 Isshiki ..... H01R 13/4367 439/247
2002/0177335 A1 * 11/2002 Tsuchioka ..... G06K 19/077 439/76.1
2004/0110412 A1 * 6/2004 Ueda ..... H01R 13/115 439/495
2004/0242034 A1 * 12/2004 Rinehart ..... H01H 33/662 439/100
2005/0020141 A1 * 1/2005 Mizutani ..... H01R 13/5202 439/677
2005/0272282 A1 * 12/2005 Setaka ..... G01R 1/06755 439/86
2006/0154500 A1 * 7/2006 Igarashi ..... G01R 1/0735 439/86
2006/0211280 A1 * 9/2006 Igarashi ..... G01R 1/0735 439/91
2006/0234534 A1 * 10/2006 Sato ..... B41J 2/14233 439/157
2006/0281373 A1 12/2006 Anbo et al.
2007/0004239 A1 * 1/2007 Hougham ..... H01R 13/2414 439/66
2007/0155200 A1 * 7/2007 Shinohira ..... H01R 9/24 439/76.2
2007/0161285 A1 * 7/2007 Saitou ..... G01R 1/07314 439/495
2010/0159719 A1 * 6/2010 Kuwabara ..... H05K 1/144 439/66
2011/0159713 A1 * 6/2011 Sato ..... C09J 4/06 439/78
2011/0294369 A1 * 12/2011 Miyashita ..... H01T 13/39 439/890
2012/0184142 A1 * 7/2012 Furukawa ..... H01R 43/24 439/620.22

FOREIGN PATENT DOCUMENTS

JP 2008-91047 4/2008
WO 2004/114471 12/2004

* cited by examiner

CARD EDGE CONNECTOR

BACKGROUND

1. Field of the Invention

The present invention relates to a card edge connector.

2. Description of the Related Art

A card edge connector provided with a housing connector in which a plurality of terminal fittings are juxtaposed in a harness-side housing and a board-side connector in which a circuit board is attached to a board-side housing is disclosed in Japanese Unexamined Patent Publication No. 2008-091047. The plurality of terminal fittings are individually accommodated in a plurality of terminal accommodating chambers provided in the harness-side housing and positioned so as not be displaced in a juxtaposition direction. On the other hand, a plurality of contact portions are provided at the same intervals as the terminal fittings on a connecting edge part of the circuit board. When the two housings are connected, the plurality of terminal fittings and the plurality of contact portions of the circuit board are resiliently brought into contact.

PBT resin (polybutylene terephthalate) is widely used as a material of the harness-side housing and glass epoxy resin is widely used as a material of the circuit board. A linear expansion coefficient of the PBT resin is approximately 100 ppm/C.°, whereas that of the glass epoxy resin is approximately 10 to 15 ppm/C.°. The material of the harness-side housing and that of the circuit board have largely different linear expansion coefficients.

In the case of installing such a card edge connector under a high-temperature environment such as an engine room, the juxtaposition interval of the terminal fittings and that of the contact portions of the circuit board deviate, wherefore contact reliability may be reduced.

The prevent invention was completed in view of the above situation and aims to improve contact reliability.

SUMMARY OF THE INVENTION

The present invention is directed to a card edge connector with a harness-side connector in which a plurality of terminal fittings are juxtaposed in a harness-side housing and a board-side connector in which a circuit board is attached to a board-side housing, the plurality of terminal fittings being resiliently brought into contact with a plurality of contact portions juxtaposed on the circuit board when the board-side housing is connected to the harness-side housing, wherein the harness-side housing includes a terminal accommodating portion for accommodating the plurality of terminal fittings in a state positioned in a juxtaposition direction, the terminal accommodating portion includes a housing main body formed with resiliently deflectable locking lances for retaining the terminal fittings and a terminal holding member separate from the housing main body and configured to hold the plurality of terminal fittings, the terminal holding member is accommodated in the housing main body, and a linear expansion coefficient of the terminal holding member is substantially equal to that of the circuit board and smaller than that of the housing main body.

According to this configuration, since "the material of the terminal holding member for holding the terminal fittings out of the housing main body and the terminal holding member constituting the terminal accommodating portion and the material of the circuit board have substantially the same linear expansion coefficient, a juxtaposition interval of the terminal fittings and that of the contact portions of the circuit board are unlikely to deviate when the card edge connector becomes hot. Thus, the card edge connector of the present invention is excellent in contact reliability. "Further, it is possible to reliably retain the terminal fittings by the resiliently deflectable locking lances while suppressing a deviation between the juxtaposition interval of the contact portions of the circuit board and that of the terminal fittings during thermal expansion and contraction.

DETAILED DESCRIPTION

Figure 1:
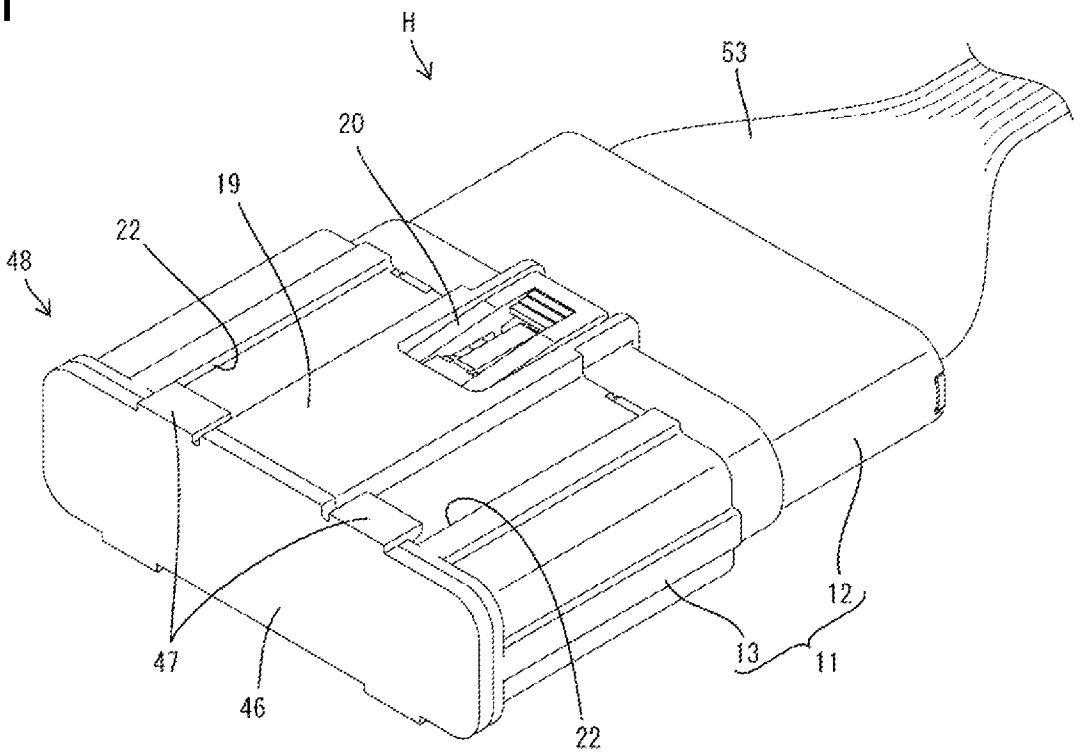
FIG. 1 is a perspective view of a card edge connector of one embodiment.

In the card edge connector of the present invention, the terminal accommodating portion may include a housing main body formed with resiliently deflectable locking lances for retaining the terminal fittings and a terminal holding member separate from the housing main body and made of a material having a linear expansion coefficient substantially equal to that of the circuit board.

According to this configuration, it is possible to reliably retain the terminal fittings by the resiliently deflectable locking lances while suppressing a deviation between the juxtaposition interval of the contact portions of the circuit board and that of the terminal fittings during thermal expansion and contraction.

In the card edge connector of the present invention, the terminal fitting may include a resilient contact piece to be resiliently brought into contact with the contact portion, and the terminal holding member may hold at least parts of the terminal fittings corresponding to the resilient contact pieces in a state positioned in the juxtaposition direction.

According to this configuration, the deviation between the interval of the resilient contact pieces and that of the contact portions during thermal expansion and contraction can be effectively suppressed since the terminal holding member holds at least the parts of the terminal fittings corresponding to the resilient contact pieces in the state positioned in the juxtaposition direction.

In the card edge connector of the present invention, the terminal fitting may include a resilient contact piece to be resiliently brought into contact with the contact portion and a box portion for holding the resilient contact piece, the locking lance may be locked to a rear end of the box portion from behind, and the terminal holding member may hold the box portions over the entire length in a state positioned in the juxtaposition direction.

According to this configuration, the orientation of the terminal fittings is kept constant by the terminal holding member in the process of thermal expansion and contraction since the terminal holding member holds the box portions over the entire length.

Hereinafter, one specific embodiment of the present invention is described with reference to FIGS. 1 to 7. A card edge connector of this embodiment includes a harness-side connector H and a board-side connector P as shown in FIGS.

2 and 3. The board-side connector P is connected to the harness-side connector H from front of the harness-side connector H. In the following description, forward and backward directions are based on the harness-side connector H. Further, a front-back direction and a connecting direction of the two connectors H, P are synonymous.

<Harness-Side Connector H>

The harness-side connector H includes a harness-side housing 10, a plurality of terminal fittings 50 and as many wires 53 as the terminal fittings 50. The plurality of terminal fittings 50 are accommodated in the harness-side housing 10 while being juxtaposed at predetermined intervals in a lateral direction (width direction). The wire 53 is connected to a rear end part of each terminal fitting 50. These wires 53 are drawn out to a side backwardly of the harness-side housing 10.

<Harness-Side Housing 10>

The harness-side housing 10 includes a housing main body 11, a one-piece rubber plug 23, a rear holder 25, a terminal holding member 30, a seal ring 45, a cap 46 and a resilient member 49 and is configured by assembling these components 11, 23, 25, 30, 45 and 46.

Figure 6:
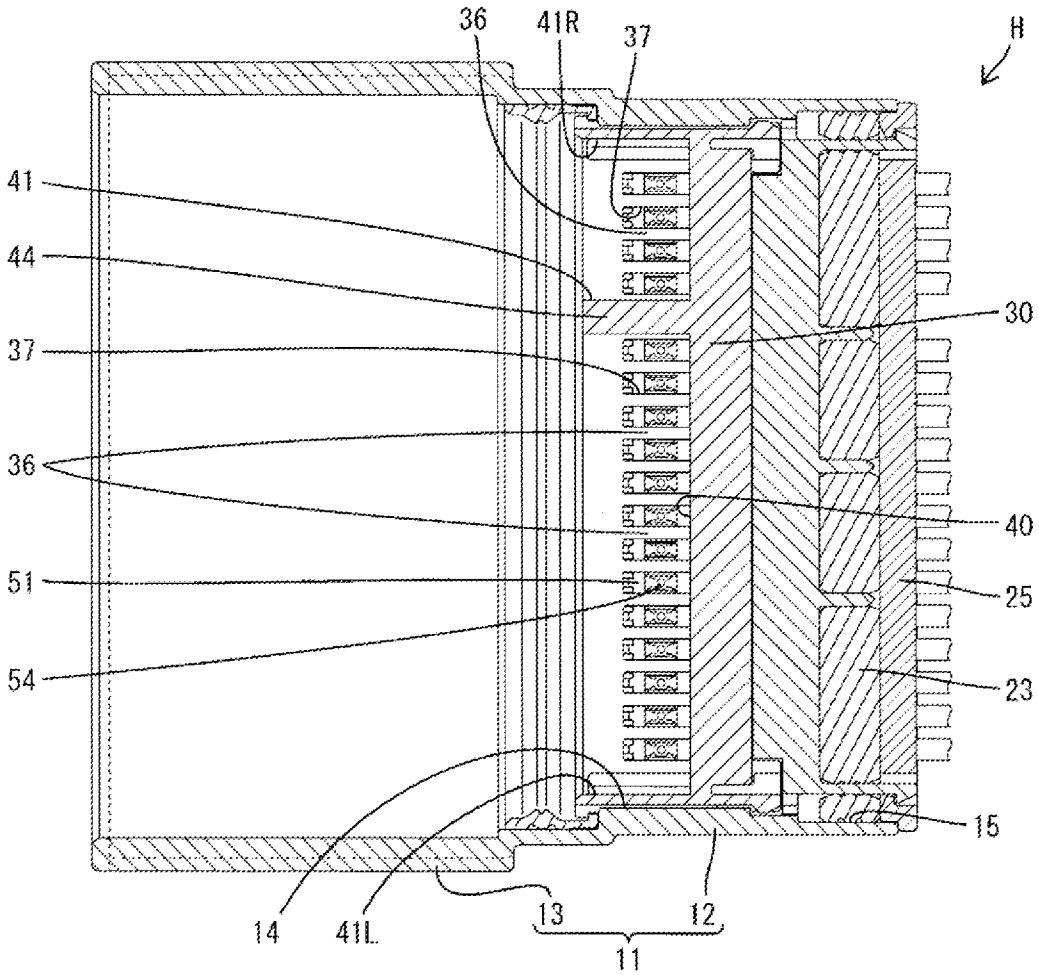
FIG. 6 is a section along X-X of FIG. 5.
Figure 7:
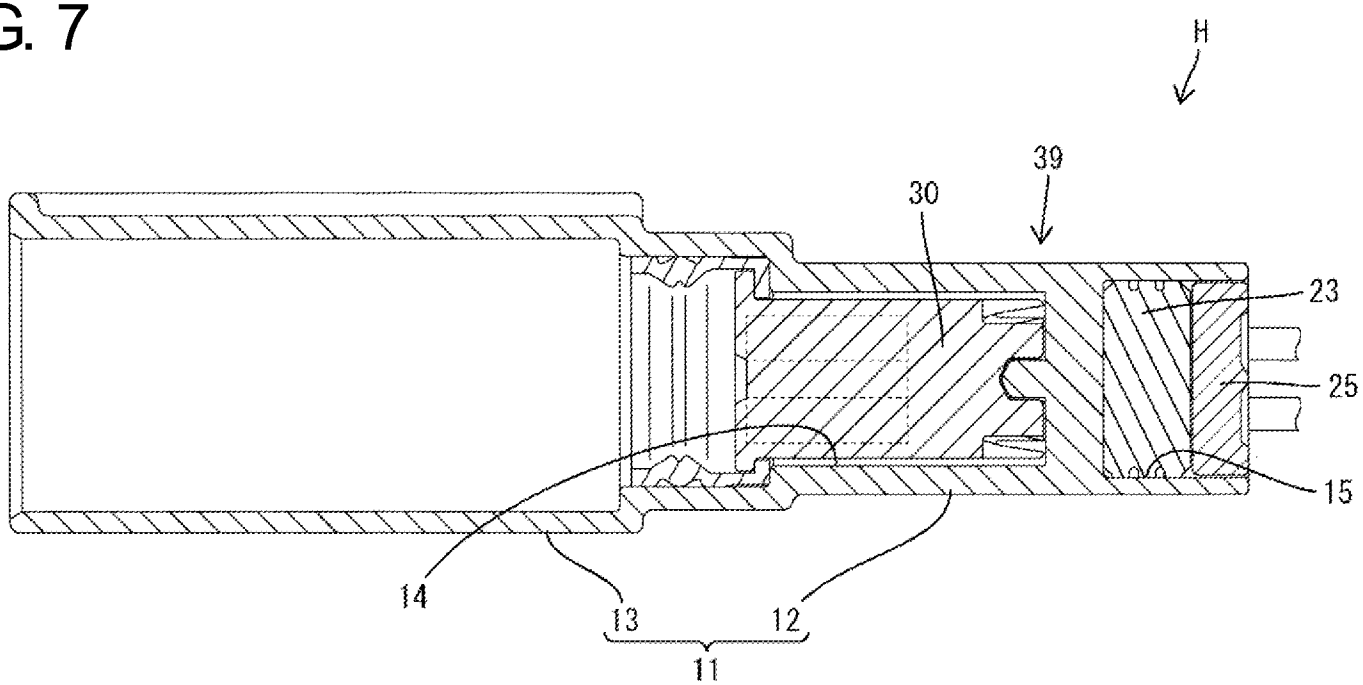
FIG. 7 is a section along Y-Y of FIG. 5.

The housing main body 11 is made of a PBT resin (polybutylene terephthalate) material to form resiliently deflectable locking lances 18 to be described later. A linear expansion coefficient of the PBT resin is approximately 100 ppm/C.°. The housing main body 11 has, as a whole, a flat outer shape in which a height (vertical dimension) is set to be smaller than a width and a dimension in the front-back direction. The housing main body 11 is configured by integrally forming a main body portion 12 and a receptacle 13 cantilevered forward from the outer peripheral edge of the front end of the main body portion 12. As shown in FIGS. 6 and 7, a single front space 14 is formed in the main body portion 12 by recessing a substantially entire area of the front end surface of the main body portion 12. The terminal holding member 30 is accommodated into the front space 14. Further, a single rear space 15 is formed in the main body portion 12 by recessing a substantially entire area of the rear end surface of the main body portion 12.

Figure 2:
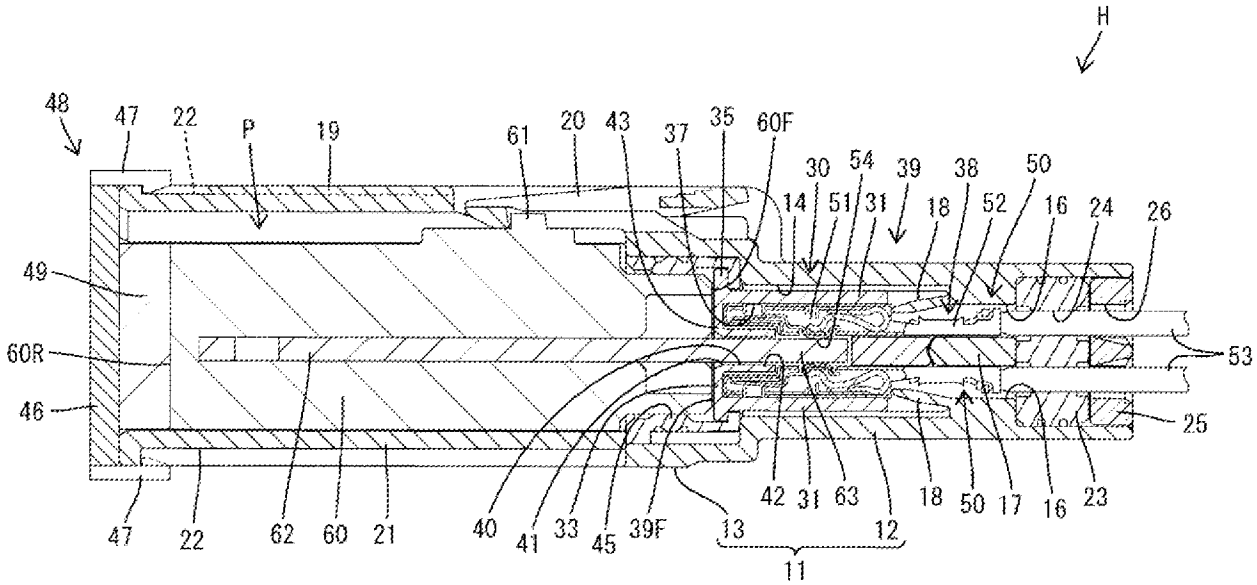
FIG. 2 is a side view in section of the card edge connector.

As shown in FIG. 2, a plurality of rear cavities 16 allowing communication between the front and rear spaces 14 and 15 of the main body portion 12 are formed between the both spaces 14, 15. The plurality of rear cavities 16 are juxtaposed at predetermined intervals in the width direction into each of two separate upper and lower rows. The rear cavities 16 in the upper stage and those of the lower stage are separated by a separation wall 17. Further, the locking lances 18 cantilevered obliquely forward from the front ends of the respective rear cavities 16 and located in the front space 14 are formed in the main body portion 12. The locking lances 18 are resiliently deflectable in a vertical direction (direction intersecting with an inserting direction of the terminal fittings 50 into the harness-side housing 10).

An inner space of the receptacle 13 communicates with the front space 14 of the main body portion 12. The board-side connector P is accommodated into the receptacle 13 from front of the receptacle 13. A lock arm 20 is formed on an upper wall portion 19 constituting the receptacle 13. The lock arm 20 is resiliently deflectable in the vertical direction (direction intersecting with the connecting direction of the two connectors H, P). Further, each of the upper wall portion 19 and a lower wall portion 21 constituting the receptacle 13 is formed with a locking recess 22 by recessing the outer surface of a front end part thereof in a stepped manner.

As shown in FIG. 2, the one-piece rubber plug 23 and the rear holder 25 are accommodated in the rear space 15. The one-piece rubber plug 23 is formed with a plurality of seal holes 24 separated in two upper and lower stages and penetrating in the front-back direction. The one-piece rubber plug 23 is held in close contact with the inner peripheral surface of the rear space 15 in a liquid-tight manner for sealing. The rear holder 25 is assembled into the housing main body 11 in a state arranged behind and proximate to the one-piece rubber plug 23. The rear holder 25 regulates a backward separation of the one-piece rubber plug 23. The rear holder 25 is formed with a plurality of through holes 26 corresponding to the respective seal holes 24.

<Terminal Holding Member 30>

Figure 3:
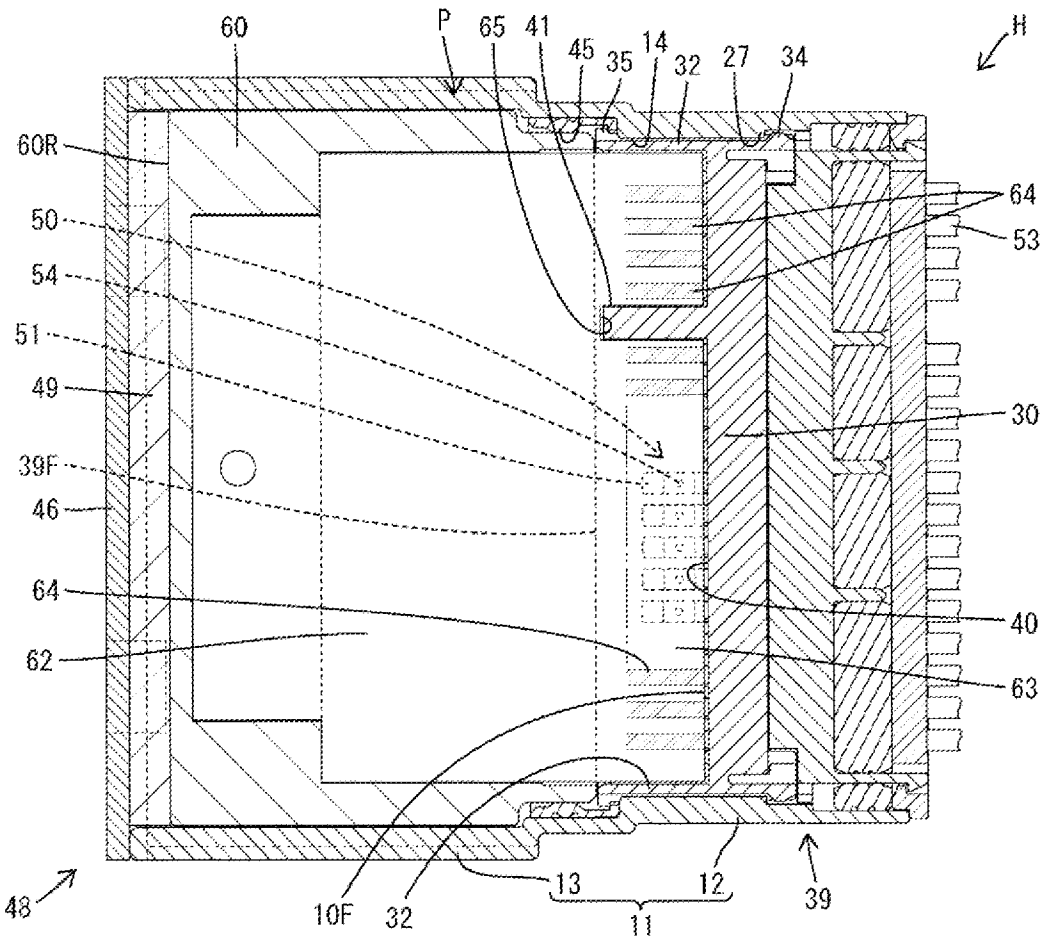
FIG. 3 is a plan view in section of the card edge connector.

The terminal holding member 30 is made of a glass-containing PPS resin (polyphenylene sulfide) material to have a linear expansion coefficient comparable to that of the circuit board 62. The linear expansion coefficient of the glass-containing PPS resin is approximately 10 to 30 ppm/C.° (e.g. Torelina (registered trademark), which is PPS resin produced by Toray Industries Inc., has a linear expansion coefficient of 23 ppm/C.° in a flowing direction and a linear expansion coefficient of 31 ppm/C.° in a perpendicular direction). The linear expansion coefficient of the glass-containing PPS resin of the terminal holding member 30 is about 1/10 to 3/10 of that of the PBT resin of the housing main body 11. The terminal holding member 30 has, as a whole, a flat outer shape in which a height (vertical dimension) is set to be smaller than a width. As shown in FIGS. 2 and 3, the terminal holding member 30 is a single component including a pair of upper and lower supporting wall portions 31, a pair of left and right side wall portions 32 and a front wall portion 33. The pair of side wall portions 32 couple opposite left and right end edges of the both upper and lower supporting wall portions 31. The front wall portion 33 couples front end edges of the both supporting wall portions 31 and is connected to the front ends of the side wall portions 32. Any of these wall portions 31, 32 and 33 constitutes an outer wall surface of the terminal holding member 30.

The terminal holding member 30 is accommodated in the front space 14. As shown in FIG. 3, resilient locking pieces 34 formed on the outer surfaces of the both left and right side wall portions 32 of the terminal holding member 30 are locked to locking steps 27 formed on the opposite left and right inner surfaces of the front space 14. By this locking action of the resilient locking pieces 34 and the locking steps 27, the terminal holding member 30 is held in the front space 14. As shown in FIGS. 2 and 3, a flange portion 35 is formed on the outer periphery of a front end part of the terminal holding member 30. A rear end part of the seal ring 45 made of rubber is locked to this flange portion 35. By this locking action, the seal ring 45 is assembled into the housing main body 11 in a state where the outer periphery thereof is held in close contact with the inner periphery of a rear end part of the receptacle 13 and the seal ring 45 is arranged before the terminal holding member 30.

As shown in FIG. 6, a plurality of rib-like partition walls 36 projecting from the inner surfaces of the both supporting wall portions 31 toward a vertical center are formed in the terminal holding member 30. The partition walls 36 are long and narrow in the front-back direction and juxtaposed in the lateral direction. A space defined by the supporting wall portion 31 and the partition walls 36 serves as a front cavity 37. Thus, a plurality of (as many as the rear cavities 16) front cavities 37 separated in two upper and lower stages are juxtaposed at predetermined intervals (same intervals as the rear cavities 16) in the width direction. The inner surfaces of the supporting wall portions 31 and the side surfaces of the partition walls 36 are directly facing the front cavities 37. The plurality of front cavities 37 and the plurality of rear cavities 16 are respectively arranged one after the other in one-to-one correspondence to constitute terminal accommodating chambers 38. The main body portion 12 of the housing main body 11 and the terminal holding member 30 constitute a terminal accommodating portion 39 for accommodating the plurality of terminal fittings 50 in juxtaposition.

As shown in FIG. 2, out of an inner space of the terminal holding member 30, a space between the front cavities 37 in the upper stage and those in the lower stage serves as a single board accommodation space 40 set to have a smaller vertical dimension than a lateral dimension. The front cavities 37 in the upper stage and those in the lower stage are directly facing the board accommodation space 40. The front wall portion 33 is formed with a slit-like board insertion port 41 long and narrow in the lateral direction and penetrating in the front-back direction. The front end of the board accommodation space 40 communicates with the board insertion port 41.

Further, the front wall portion 33 is formed with a pair of upper and lower receiving plate portions 42 for supporting front end parts of box portions 51 of the terminal fittings 50 accommodated in the front cavities 37. The receiving plate portions 42 are cantilevered backward from a pair of upper and lower long-side opening edges 43 along the lateral direction (length direction of the board insertion port 41) out of opening edges of the board insertion port 41. In a state where the box portions 51 of the terminal fittings 50 are accommodated in the front cavities 37, displacements of the front end parts of the box portions 51 toward the board accommodation space 40 are regulated by the receiving plate portions 42. In this way, the terminal fittings 50 are so held as not be vertically inclined.

Since the front ends of the supporting wall portions 31 are connected to the front wall portion 33, the front wall portion 33 is deformed to be vertically expanded if the supporting wall portion 31 is deformed to bulge toward an outer surface side of the terminal holding member 30 (upwardly or downwardly). Associated with this deformation of the front wall portion 33, the upper and lower long-side opening edges 43 of the board insertion port 41 are relatively displaced away from each other. In this embodiment, the front wall portion 33 is formed with one coupling portion 44 for coupling the long-side opening edges 43 as shown in FIGS. 3, 5 and 6 as a means for preventing the board insertion port 41 from being deformed to be vertically widened.

The front end edge of the coupling portion 44 is connected to the front wall portion. The upper end edge of the coupling portion 44 is connected to the upper supporting wall portion 31. The lower end edge of the coupling portion 44 is connected to the lower supporting wall portion 31. The rear end edge of the coupling portion 44 is connected to the front end of the separation wall 17. That is, the coupling portion 44 is connected in an entire area from the front ends to the rear ends of the pair of upper and lower supporting wall portions 31. Thus, the deformation of the upper and lower supporting wall portions 31 away from each other is regulated by this coupling portion 44.

Figure 5:
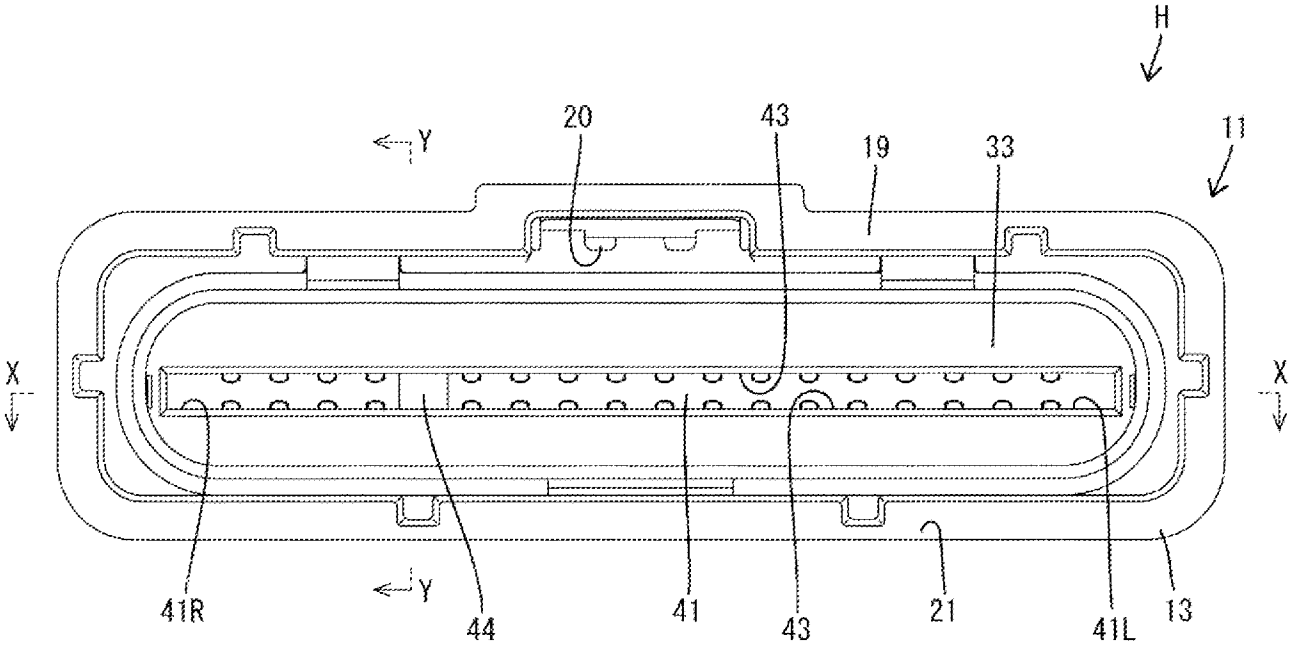
FIG. 5 is a front view of the harness-side connector.

Further, by being formed with the coupling portion 44, the board insertion port 41 is divided into two left and right opening areas 41L, 41R as shown in FIGS. 5 and 6. Accordingly, two (a plurality of) opening areas 41L, 41R correspond to the board accommodation space 40 as a single space. The coupling portion 44 is arranged at a position deviated in the lateral direction from a central position of the long-side opening edges 43 in the length direction. That is, the coupling portion 44 is asymmetrically arranged in the lateral direction. The shapes and sizes of the two opening areas 41L, 41R are asymmetrical in the lateral direction.

As shown in FIG. 2, the cap 46 made of synthetic resin is mounted on the receptacle 13 to close an opening on the front end of the receptacle 13 from front. A board-side housing 60 is entirely accommodated in the receptacle 13 in a state where the both connectors H, P are properly connected. Thus, the cap 46 is in the form of a flat plate as a whole. A locking arm 47 is formed on each of upper and lower end edges of the cap 46. The cap 46 mounted on the receptacle 13 is held so as not be separated forwardly from the receptacle 13 by locking the locking arms 47 to the locking recesses 22 of the receptacle 13. This cap 46 and the receptacle 13 constitute a housing accommodating portion 48 for accommodating the board-side housing 60.

The housing accommodating portion 48 is arranged before and adjacent to the terminal accommodating portion 39. Further, an inner space of the housing accommodating portion 48 communicates with the board accommodation space 40 via the board insertion port 41. The resilient member 49 made of a rubber material is accommodated in the housing accommodating portion 48. The resilient member 49 is arranged to be held in close contact with a substantially entire area of the inner surface (rear surface) of the cap 46. The rear surface of the resilient member 49 is held in close contact with a substantially entire area of a rear surface 60R of the board-side housing 60. When the cap 46 is mounted on the receptacle 13, the resilient member 49 is sandwiched between the cap 46 and the board-side housing 60 to be resiliently squeezed.

<Terminal Fitting 50>

The terminal fitting 50 is formed into a long and narrow shape in the front-back direction (direction perpendicular to a juxtaposition direction of the terminal fittings 50) as a whole. The terminal fitting 50 is formed by bending and assembling two metal plate members punched out into predetermined shapes. As shown in FIG. 2, a front end side area of the terminal fitting 50 serves as the box portion 51 of a known form. A rear end side area of the terminal fitting 50 serves as a crimping portion 52 of a known form, and a front end part of the wire 53 constituting a wiring harness is connected to the crimping portion 52 by crimping. The box portion 51 includes a resilient contact piece 54. A part of the resilient contact piece 54 projects out from the box portion 51.

The terminal fitting 50 is inserted into the terminal accommodating chamber 38 by successively passing through the through hole 26 of the rear holder 25 and the seal hole 24 of the one-piece rubber plug 23. The inserted terminal fitting 50 has the rear end of the box portion 51 locked by the locking lance 18, thereby being retained and held. With the terminal fitting 50 inserted, the box portion 51 and the resilient contact piece 54 are arranged in the front cavity 37 and the crimping portion 52 is arranged in the rear cavity 16. That is, the box portion 51 (front end side part of the terminal fitting 50) is held over the entire length from the front end to the rear end thereof by the terminal holding member 30. Further, the crimping portion 52 (rear end side part of the terminal fitting 50) is arranged over the entire length thereof in the housing main body 11.

With the terminal fitting 50 inserted in each terminal accommodating chamber 38, a part of the resilient contact piece 54 projects toward a side opposite to the supporting wall portion 31 and is located in the board accommodation space 40. Further, each terminal fitting 50 is sandwiched from left and right sides by the partition walls 36, thereby being positioned with respect to the terminal holding member 30 so as not to largely rattle in the lateral direction (juxtaposition direction).

<Board-Side Connector P>

Figure 4:
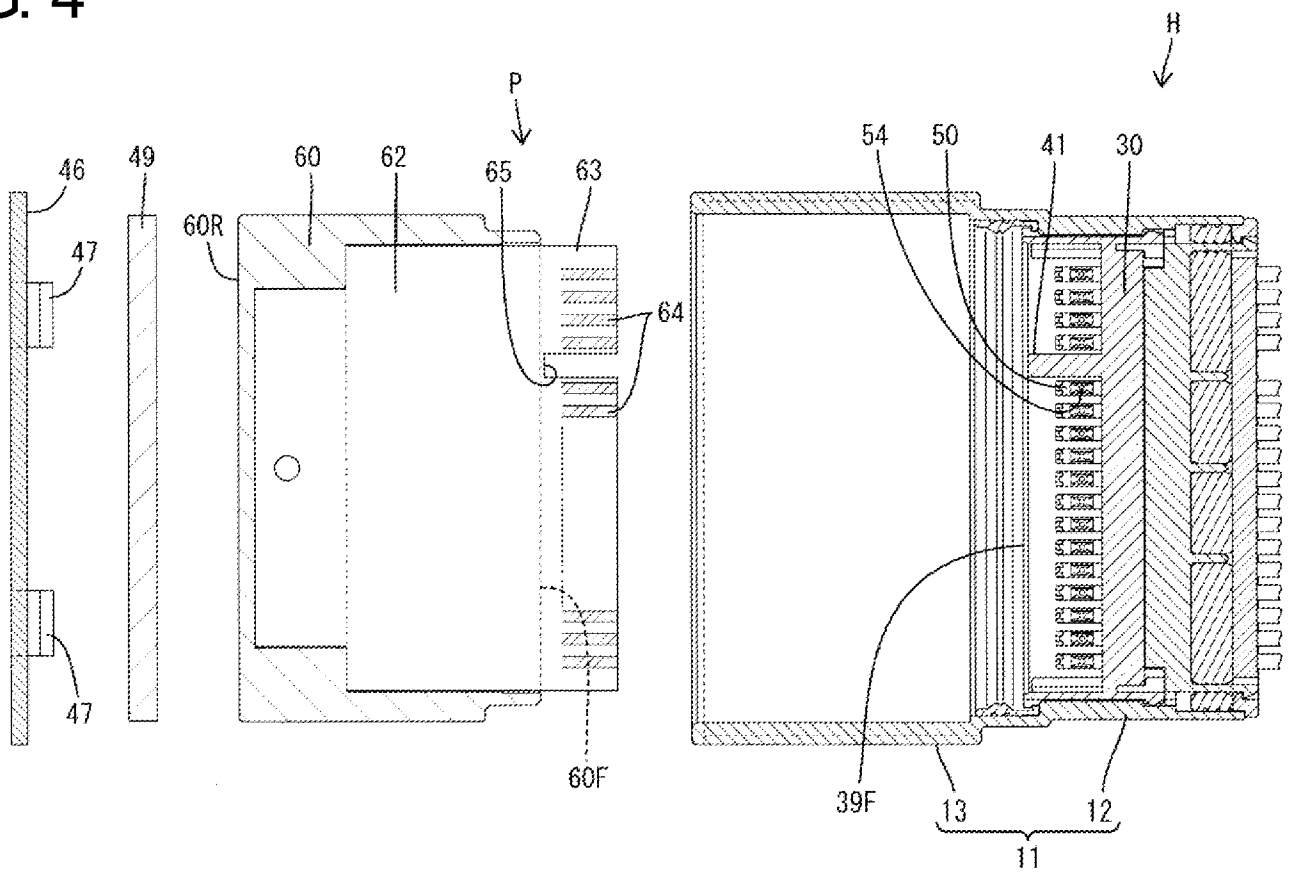
FIG. 4 is a plan view in section showing a state where a harness-side connector and a board-side connector are separated.

As shown in FIGS. 2 to 4, the board-side connector P is an integral assembly of the board-side housing 60 made of synthetic resin and the circuit board 62 by molding. The board-side housing 60 has a flat shape as a whole in which a height (vertical dimension) is set to be smaller than a width. As shown in FIG. 2, a lock projection 61 is formed on the upper surface (outer surface) of the board-side housing 60. Circuits are formed by printing and electronic components and the like (not shown) are mounted on opposite upper and lower surfaces (both sides) of the circuit board 62. An end edge part of the circuit board 62 on the side of the harness-side connector H serves as a connecting edge portion 63 as a connection means to the terminal fittings 50.

The circuit board 62 is made of a glass epoxy resin material. A linear expansion coefficient of the glass epoxy resin material is approximately 10 to 15 ppm/° C. substantially equal to that of the glass-containing PPS resin as the material of the terminal holding member 30. An entire area of the circuit board 62 except the connecting edge portion 63 is embedded in the board-side housing 60. Accordingly, the connecting edge portion 63 of the circuit board 62 projects from a front surface 60F of the board-side housing 60 toward the harness-side housing 10. As shown in FIGS. 3 and 4, a plurality of contact portions 64 constituting the circuits are juxtaposed at the same interval as the terminal fittings 50 on opposite upper and lower surfaces of this connecting edge portion 63. Further, the connecting edge portion 63 is formed with a cut portion 65 corresponding to the coupling portion 44 of the harness-side housing 10.

<Functions and Effects>

In connecting the harness-side connector H and the board-side connector P, the board-side connector P is inserted into the receptacle 13 with the cap 46 removed from the receptacle 13. In an inserting process, the connecting edge portion 63 of the circuit board 62 is inserted into the board accommodation space 40 through the board insertion port 41. At this time, the cut portion 65 and the coupling portion 44 are press-fitted and engaged. When the two connectors H, P are properly connected, they are locked in a connected state by the locking action of the lock arm 20 and the lock projection 61. Further, the resilient contact pieces 54 of the terminal fittings 50 in the upper and lower stages respectively resiliently come into contact with the contact portions 64 on the upper and lower surfaces of the connecting edge portion 63 and the circuit board 62 and the terminal fittings 50 are electrically conductively connected. Further, a clearance between the inner surface of the receptacle 13 and the outer surface of the board-side housing 60 is sealed by the seal ring 45.

After the board-side connector P is inserted into the receptacle 13, the resilient member 49 is held in close contact with the rear surface 60R of the board-side housing 60 and the cap 46 is brought into contact with the front surface of the resilient member 49 and mounted on the receptacle 13. Then, the resilient member 49 is resiliently deformed to be squeezed in the front-back direction, and the front surface 60F of the board-side housing 60 is resiliently pressed against a front surface 39F of the terminal accommodating portion 39 (terminal holding member 30) by a resilient restoring force of this resilient member 49. By this resilient pressing action, relative displacements of the two housings 10, 60 in the front-back direction are regulated. Further, relative displacements of the two housings 10, 60 in directions (vertical direction and lateral direction) intersecting with the connecting direction due to a frictional force resulting from resilient pressing are also regulated. In the above way, the connection of the two connectors H, P is completed.

In the card edge connector of this embodiment, the harness-side housing 10 is provided with the terminal accommodating portion 39 for accommodating the plurality of terminal fittings 50 and the housing accommodating portion 48 arranged to face the front surface 39F of the terminal accommodating portion 39 and configured to accommodate the board-side housing 60. The resilient member 49 for biasing the terminal accommodating portion 39 and the board-side housing 60 in a direction toward each other in parallel to the connecting direction is provided in the housing accommodating portion 48.

According to this configuration, relative displacements of the board-side housing 60 and the terminal accommodating portion 39 are regulated by a biasing force of the resilient member 49, wherefore position shifts between the terminal fittings 50 and the circuit board 62 caused by vibration resulting from relative displacements of the two housings 10, 60 are prevented. Thus, the card edge connector of this embodiment is excellent in the contact reliability of the terminal fittings 50 and the circuit board 62.

Further, the housing accommodating portion 48 includes the receptacle 13 integrated with the terminal accommodating portion 39 and projecting forwardly of the terminal accommodating portion 39 and the cap 46 to be mounted on the receptacle 13 to close the opening on the front end of the receptacle 13. According to this configuration, when the two housings 10, 60 are connected, the board-side housing 60 is accommodated into the receptacle 13. Thus, the two housings 10, 60 can be positioned so as not to be displaced relative to each other until the cap 46 is mounted.

Further, the entire board-side housing 60 is accommodated in the receptacle 13 with the two connectors H, P properly connected. Thus, the board-side housing 60 can be protected from the interference of external matters until the resilient member 49 and the cap 46 are mounted after the two connectors H, P are connected.

Further, the resilient member 49 is arranged between the rear surface 60R of the board-side housing 60 in the receptacle 13 and the inner surface of the cap 46. According to this configuration, the board-side housing 60 is pressed against the terminal accommodating portion 39 by being biased from the side of the rear surface 60R by the resilient member 49, and relative displacements of the harness-side housing 10 and the board-side housing 60 are regulated by this pressing action. Thus, in the card edge connector of this embodiment, a projecting distance of the circuit board 62 from the board-side housing 60 can be made shorter as compared with the case where the resilient member 49 is interposed between the front surface 39F of the terminal accommodating portion 39 and the front surface 60F of the board-side housing 60.

Further, the resilient member 49 is produced as a component separate from the housing accommodating portion 48. This resilient member 49 is accommodated in the housing accommodating portion 48. If an attempt is made to integrally form a component constituting the housing accommodating portion 48 and the resilient member 49, there are restrictions such as the possibility of mold removal, resilient strength and the like. Thus, a degree of freedom in design is low. Contrary to this, in this embodiment, the resilient member 49 is a component separate from the housing accommodating portion 48. Thus, a degree of freedom is high in designing the housing accommodating portion 48 and the resilient member 49.

Further, since the board-side housing 60 is integrally formed to the circuit board 62 by molding, there is no relative displacement between the board-side housing 60 and the circuit board 62. Since relative displacements of the board-side housing 60 and the harness-side housing 10 are regulated by the resilient member 49, relative displacements of the terminal fittings 50 to the circuit board 62 are reliably regulated.

Further, since the resilient contact pieces 54 of the terminal fittings 50 are resiliently in contact with the circuit board 62 in a state where the terminal fittings 50 and the circuit board 62 are connected, reaction forces resulting from resilient restoring forces of the resilient contact pieces 54 are given toward the terminal fittings 50 from the side of the circuit board 62. These reaction forces are received by the supporting wall portions 31 located at sides of the terminal fittings 50 opposite to the circuit board 62. However, since the supporting wall portions 31 are provided along the plurality of juxtaposed terminal fittings 50, the rigidity of the supporting wall portions 31 is reduced if a large number of terminal fittings 50 are juxtaposed and the supporting wall portions 31 have a large width. In this case, the supporting wall portions 31 may be curved and deformed to bulge out in directions away from the circuit board 62 (upwardly or downwardly) without being able to receive the reaction forces from the side of the circuit board 62. If such deformation occurs, a contact pressure between the terminal fittings 50 and the circuit board 62 may be reduced.

Accordingly, in this embodiment, the pair of long-side opening edges 43 substantially parallel to the supporting wall portions 31 out of the opening edges of the board insertion port 41 are coupled by the coupling portion 44, focusing on the board insertion port 41 of the front wall portion 33 connected to the front end edges of the supporting wall portions 31. Since vertical widening of the board insertion port 41 can be regulated in this way, the deformation of the upper and lower edge parts of the front wall portion 33 to bulge outwardly is also regulated and, consequently, the upper and lower supporting wall portions 31 are prevented from being curved and deformed. Since the supporting wall portions 31 can reliably receive reaction forces resulting from the resilient pressing action of the resilient contact pieces 54 in this way, the contact pressure between the terminal fittings 50 and the circuit board 62 can be kept at a predetermined value.

Further, since the connecting edge portion 63 of the circuit board 62 is inserted into the board insertion port 41, the circuit board 62 may interfere with the coupling portion 44 to obstruct the connection of the two connectors H, P. However, since the connecting edge portion 63 of the circuit board 62 is formed with the cut portion 65 for avoiding interference with the coupling portion 44 in the inserting process into the board insertion port 40, the connection of the two connectors H, P is not obstructed.

Further, the front wall portion 33 constitutes the terminal accommodating chambers 38 for accommodating the plurality of terminal fittings 50. The coupling portion 44 and the cut portion 65 are engaged while being held in contact in the juxtaposition direction of the terminal fittings 50. According to this configuration, by the engagement of the coupling portion 44 and the cut portion 65, the plurality of contact portions 64 of the circuit board 62 and the resilient contact pieces 54 of the plurality of terminal fittings 50 are positioned in the juxtaposition direction of the terminal fittings 50. Thus, contact reliability is excellent. In addition, since the coupling portion 44 and the cut portion 65 is press-fitted and engaged, relative displacements of the circuit board 62 and the terminal fittings 50 are regulated not only in the lateral direction, but also in the front-back direction and the vertical direction. Therefore, even if the card edge connector receives vibration, the contact pressure between the terminal fittings 50 and the circuit board 62 is stable.

Further, the coupling portion 44 and the cut portion 65 are arranged at the position deviated from the central position of the long-side opening edges 43 in the length direction. According to this configuration, if an attempt is made to insert the circuit board 62 in a laterally inverted incorrect posture into the board insertion port 41, the circuit board 62 interferes with the coupling portion 44, wherefore the insertion of the circuit board 62 in an incorrect posture can be prevented.

Further, the harness-side housing 10 includes the terminal accommodating portion 39 for accommodating the plurality of terminal fittings 50 in the state positioned in the juxtaposition direction. At least a part (terminal holding member 30) of the terminal accommodating portion 39 is made of the material (PPS resin) having a linear expansion coefficient substantially equal to that of the material (glass epoxy resin) of the circuit board 62. According to this configuration, when the card edge connector becomes hot, the juxtaposition interval of the terminal fittings 50 and that of the contact portions 64 of the circuit board 62 are unlikely to deviate from each other. Thus, the card edge connector of this embodiment is excellent in contact reliability.

Further, the terminal accommodating portion 39 includes the housing main body 11 and the terminal holding member 30. The housing main body 11 is formed with the locking lances 18 resiliently deflectable to retain the terminal fittings 50. The terminal holding member 30 is separate from the housing main body 11 and made of the material having a linear expansion coefficient approximately equal to that of the circuit board 62. According to this configuration, the terminal fittings 50 can be reliably retained by the resiliently deflectable locking lances 18 while suppressing a deviation between the juxtaposition interval of the contact portions 64 of the circuit board 62 and that of the terminal fittings 50 during thermal expansion and contraction.

Further, the terminal fitting 50 includes the resilient contact piece 54 to be resiliently brought into contact with the contact portion 64 of the circuit board 62. The terminal holding member 30 holds at least a part of the terminal fitting 50 corresponding to the resilient contact piece 54 in the state positioned in the juxtaposition direction. According to this configuration, a deviation between the juxtaposition interval of the resilient contact pieces 54 and that of the contact portions 64 during thermal expansion and contraction can be effectively suppressed.

Further, the terminal holding member 30 constituting the front end of the terminal accommodating portion 39 and the main body portion 12 constituting the rear end side of the terminal accommodating portion 39 have different linear expansion coefficients. Thus, in the process of thermal expansion and contraction, a displacement amount in the lateral direction differs between the front end side and the rear end side of the terminal fitting 50. As a result, the terminal fitting 50 may be inclined in the lateral direction. However, in this embodiment, the front end side part of the terminal fitting 50 serves as the box portion 51 for holding the resilient contact piece 54 and this box portion 51 is held over the entire length thereof in the state positioned in the juxtaposition direction by the terminal holding member 30. Thus, the orientation of the terminal fitting 50 is kept constant by the terminal holding member 30 in the process of thermal expansion and contraction.

Further, the board-side housing 60 is accommodated over the entire length thereof in the receptacle 13 in the state where the harness-side connector H and the board-side connector P are properly connected. That is, the entire board-side housing 60 is accommodated in the receptacle 13. This structure enables position shifts between the housings 10 and 60 due to vibration to be suppressed also in a state where the cap 46 and the resilient member 49 are not assembled yet as compared with the case where a projecting distance of the receptacle 13 is short and only a part of the board-side housing 60 is accommodated in the receptacle 13.

Further, the card edge connector of this embodiment can be used without assembling the cap 46 and the resilient member 49 in the state where the harness-side connector H and the board-side connector P are connected. In this case, position shifts between the housings 10 and 60 due to vibration can be more effectively suppressed or more reliably prevented if the two housings 10, 60 are fixed so as not to move relative to each other such as by mounting a fixing member made of rubber (not shown) on the harness-side housing 10 and the board-side housing 60. As a means for reliably preventing position shifts between the housings 10 and 60 without assembling the cap 46 and the resilient member 49, the two housings 10, 60 may be fixed to a body of a vehicle (not shown) by common bolts (not shown). As just described, the card edge connector of this embodiment can suppress or prevent position shifts between the two housings 10 and 60 due to vibration by being combined with another means instead of the cap 46 and the resilient member 49.

The present invention is not limited to the above described and illustrated embodiment. For example, the following embodiments are also included in the technical scope of the present invention.

Although the terminal holding member holds the box portion over the entire length in the above embodiment, it may be configured to hold only a part of the box portion. In this case, the position where the terminal holding member holds the box portion may be a position corresponding to the resilient contact piece or a position not corresponding to the resilient contact piece.

Although the locking lance is locked to the rear end of the box portion in the above embodiment, it may be locked to the box portion at a position before the rear end.

Although the terminal holding member is made of the glass-containing PPS resin in the above embodiment, it may be made of resin other than PPS.

Although the housing main body is made of the PBT resin in the above embodiment, it may be made of resin other than PBT.

Although the terminal fittings are in contact with both sides of the circuit board in the above embodiment, the present invention can also be applied to a card edge connector in which terminal fittings are in contact only with one of both sides of a circuit board.

Although the coupling portion is arranged at the position deviated from the central position of the long-side opening edges in the length direction and the two opening areas divided by the coupling portion are laterally asymmetrical in the above embodiment, the coupling portion may be arranged at the central position of the long-side opening edges in the length direction and the two opening areas divided by the coupling portion may be bilaterally symmetrical.

LIST OF REFERENCE SIGNS

H . . . harness-side connector
P . . . board-side connector
10 . . . harness-side housing
11 . . . housing main body
18 . . . locking lance
30 . . . terminal holding member
39 . . . terminal accommodating portion
50 . . . terminal fitting
51 . . . box portion
54 . . . resilient contact piece
62 . . . circuit board
64 . . . contact portion

The invention claimed is:

1. A card edge connector assembly comprising: a board-side connector with a board-side housing and a circuit board attached to the board-side housing, a plurality of contact portions juxtaposed on the circuit board; and a harness-side connector that includes a terminal accommodating portion accommodating a plurality of terminal fittings in a state positioned in a juxtaposition direction for resiliently contacting the contact portions on the circuit board and a housing main body accommodating the terminal holding member therein and formed with resiliently deflectable locking lances for retaining the terminal fittings in the terminal holding member, wherein a linear expansion coefficient of the terminal holding member is substantially equal to that of the circuit board and smaller than that of the housing main body.

2. The card edge connector assembly of claim 1, wherein:

the terminal fitting includes a resilient contact piece to be resiliently brought into contact with the contact portion; and the terminal holding member holds at least parts of the terminal fittings corresponding to the resilient contact pieces in a state positioned in the juxtaposition direction.

3. The card edge connector assembly of claim 2, wherein:

the terminal fitting includes a resilient contact piece to be resiliently brought into contact with the contact portion and a box portion for holding the resilient contact piece;

the locking lance is locked to a rear end of the box portion from behind; and the terminal holding member holds the box portions over the entire length in a state positioned in the juxtaposition direction.

4. The card edge connector assembly of claim 3, wherein:

at least a part of the terminal accommodating portion is made of a material having a linear expansion coefficient smaller than 31 ppm/C.°.

5. The card edge connector assembly of claim 1, wherein:

the terminal fitting includes a resilient contact piece to be resiliently brought into contact with the contact portion and a box portion for holding the resilient contact piece;

the locking lance is locked to a rear end of the box portion from behind; and the terminal holding member holds the box portions over the entire length in a state positioned in the juxtaposition direction.

6. A card edge connector assembly of claim 5, wherein: at least a part of the terminal accommodating portion is made of a material having a linear expansion coefficient smaller than 31 ppm/C.°.

7. A card edge connector assembly of claim 1, wherein: at least a part of the terminal accommodating portion is made of a material having a linear expansion coefficient smaller than 31 ppm/C.°.

* * * * *